United States Patent [19]

Reid

[11] Patent Number: 4,605,830

[45] Date of Patent: Aug. 12, 1986

[54] CAMMED WIRE SNAP SWITCH

[75] Inventor: Bruce E. Reid, Freeport, Ill.

[73] Assignee: Honeywell Inc., Minneapolis, Minn.

[21] Appl. No.: 681,177

[22] Filed: Dec. 13, 1984

[51] Int. Cl.[4] ..... H01H 5/04; H01H 13/38

[52] U.S. Cl. ..... 200/73; 200/275; 200/68.1; 200/284; 200/153 LA; 74/100 R

[58] Field of Search ..... 200/74, 75, 67 D, 67 DA, 200/73, 67 R, 153 LA, 153 L, 154, 160, 159 R, 241, 245, 283, 284, 77, 68.1, 275, 5 A; 74/99 R, 99 A, 100 R, 100 D

[56] References Cited

U.S. PATENT DOCUMENTS

| | | | |
|---|---|---|---|
| 3,243,562 | 3/1966 | O'Brien | 200/283 X |
| 3,274,355 | 9/1966 | Francy | 200/68.1 |
| 3,387,184 | 6/1968 | Angold | 200/153 L X |
| 3,567,888 | 3/1971 | Long | 200/160 |
| 3,681,547 | 8/1971 | Burch et al. | 200/77 |
| 4,092,503 | 5/1978 | Raeder | 200/5 A |
| 4,466,302 | 8/1984 | Harris | 74/100 R |

*Primary Examiner*—Stephen Marcus
*Assistant Examiner*—Ernest G. Cusick
*Attorney, Agent, or Firm*—Charles L. Rubow

[57] ABSTRACT

A snap acting electrical switch in which a frame carries first, second and third wireform contacts and a plunger movable along a first axis. The first and second wireform contacts are biased together along a second axis transverse to the first axis, and are also biased against an end of the plunger. The first and second wireform contacts together are adapted to be deflected along the second axis by a cam surface on the housing as the plunger is depressed. As the second contact is caused to slide off the end of the plunger, it snaps against the third wireform contact which is in a fixed position along side the plunger.

21 Claims, 5 Drawing Figures

CAMMED WIRE SNAP SWITCH

BACKGROUND OF THE INVENTION

The invention disclosed herein relates generally to snap acting mechanisms and particularly to such mechanisms in which a resilient wire member is biased against a surface having a line of inflection, and snaps to an alternate position when moved past the line of inflection. The mechanism has particular utility in low cost miniature electrical snap switches.

Electrical switches exhibiting snap action are in exceptionally wide use. A large variety of designs are known for such switches, and such switches are available with a large variety of electrical ratings and other performance characteristics. There is considerable competition particularly among manufacturers of low power snap acting switches. As a result, there is great incentive to decrease price while still providing acceptable performance, and there is a continuing search for switch designs which are simple, suitable for miniaturization, require only a few simply built parts, and are easy to manufacture.

In line with the foregoing requirement, the applicant has devised a unique snap acting mechanism design requiring only a minimum number of simple, inexpensive, easily assembled parts, the design being well adapted for implementation in a very small package.

SUMMARY OF THE INVENTION

The present invention is most basically a snap acting mechanism in which a plunger having a surface with a line of inflection is adapted for reciprocal movement between released and depressed positions. A first resilient element is biased to a position proximate a first portion of the plunger surface, and a stationary cam surface is positioned and configured to deflect the element across the first portion of the surface toward the line of inflection as the plunger is depressed, the element, after reaching the line of inflection, tending spring along a second portion of the plunger surface away from the line of inflection.

A stationary element may be positioned such that it is adjacent the line of inflection of the plunger surface when the plunger is in its released position, and remains in proximity to the second portion of the surface as the plunger is depressed. A second resilient element may also be included, such element having a free end positioned between the cam surface and the first resilient element. The first and second resilient elements and the stationary element may be electrically conductive and formed of wire segments so as to provide an electrical switch in which the first and second resilient elements comprise normally closed contacts and the first resilient element and the stationary element comprise normally open contacts.

DESCRIPTION OF THE PREFERRED EMBODIMENT

Figure 1:
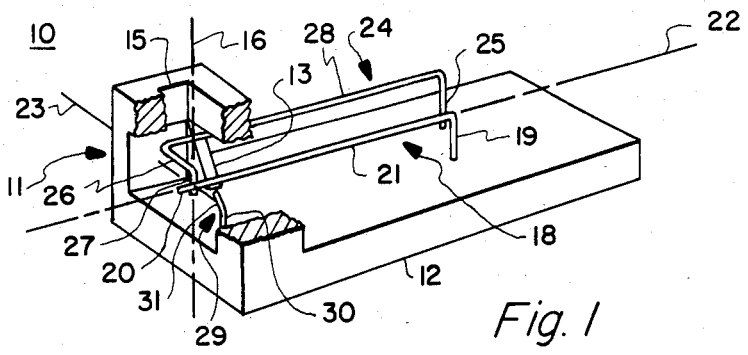
FIG. 1 is a perspective illustration of an electrical switch in accordance with applicant's invention, the switch frame being partially broken away and a plunger omitted.
Figure 3A:
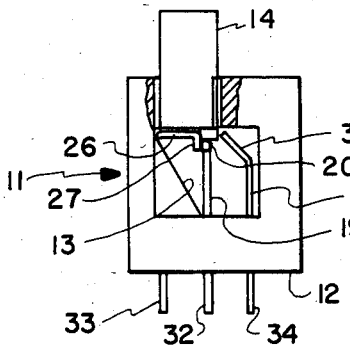
FIGS. 3(*a*)–3(*c*) are end views of the switch of FIG. 1 showing the interrelationship of the essential elements in sequence during operation.
Figure 3B:
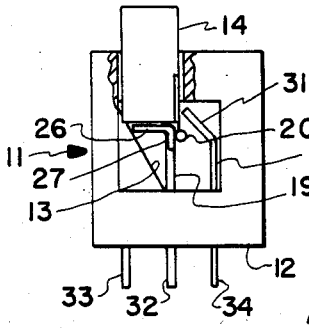
Figure 3C:
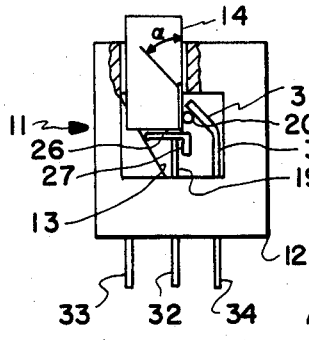

In FIGS. 1 and 3, reference numeral 10 generally identifes a switch having a frame or housing 11 including a base 12 which may be molded of a suitable plastic material. Frame 11 is configured with a cam or ramp surface 13 whose function will be described hereinafter. Frame 11 is also adapted to support a plunger 14 which is guided in a channel or aperture 15 for reciprocal movement along a first axis 16 between released and depressed positions.

A first resilient electrically conductive member or element generally identified by reference numeral 18 is mounted in frame 11. Element 18 includes a fixed end 19 shown molded into base 12, a free end 20 and an intermediate segment 21 joining fixed and free ends 19 and 20. Segment 21 extends generally along a second axis 22 which is perpendicular to axis 16. Axes 16 and 22 are perpendicular to a third axis 23.

A second resilient electrically conductive member or element generally identified by reference numeral 24 is also mounted in frame 11. Member 24 includes a fixed end 25 molded into base 12, a free end including first and second portions 26 and 27, and an intermediate segment 28 joining the fixed end and free ends. As shown in FIG. 1, segments 21 and 28 of elements 18 and 24 are substantially parallel.

Also mounted in frame 11 is a rigid electrically conductive member or element generally identified by reference numeral 29 which includes a first segment 30 molded into base 12 and a second segment 31 positioned adjacent plunger 14. Segment 31 functions both as an electrical contact and a camming surface as will be more fully described hereinafter. As shown in FIG. 3, the fixed ends of resilient elements 18 and 24 and rigid element 29 extend through base 12 to form electrical terminals 32, 33 and 34 respectively of switch 10.

Figure 2:
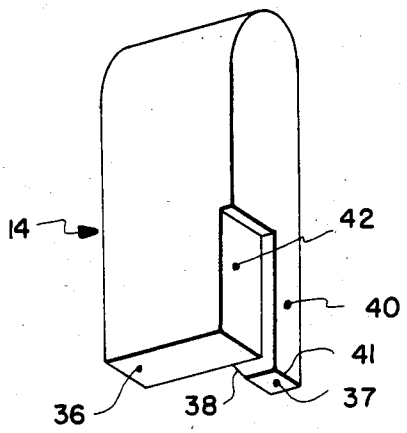
FIG. 2 is an enlarged perspective view of a plunger used in the switch of FIG. 1.

As shown in FIG. 2, plunger 14 has an end surface generally comprising a first land 36 and a second land 37 which projects from land 36. The switch embodiment illustrated in FIG. 1 is configured such that a portion of plunger 14 must be cut away to provide clearance for ramp surface 13. In the perspective view of FIG. 3, the cut away portion of plunger 14 is just visible at reference numeral 38.

Plunger 14 further has a side surface 40 which joins land 37 at a line of inflection 41. As illustrated, surface 40 is perpendicular to surfaces 36 and 37. Side surface 40 is configured with a clearance recess 42 for accommodating the end of segment 31 of rigid member 29.

The operation of switch 10 is apparent from the end view sequence of FIGS. 3(*a*)–3(*c*). As shown in FIG. 3(*a*), plunger 14 is in its released position. It is biased to the released position by resilient elements 18 and 24 of which free end 20 of element 18 rides on land 37 and free end 26, 27 of element 24 rides on land 36. Portion 26 of element 24 extends in a direction parallel with axis 23 generally toward free end 20 of element 18 and substantially perpendicular to intermediate segment 28. Portion 27 of element 24 extends generally along axis 16 and substantially perpendicular to portion 26. Element 24 is biased so that segment 28 rides on cam surface 13, and element 18 is biased so that free end 20 is urged against portion 27 of element 24. The relationship between lands 36 and 37 insures that free end 20 of element 18 does not slip between portion 26 of element 24 and end surface 36 of plunger 14.

Accordingly, free end 20 of element 18 and portion 27 of element 24 form a pair of normally closed electrical contacts between terminals 32 and 33. Similarly, free end 20 of element 18 and second segment 31 of element 29 form a pair of normally open electrical contacts between terminals 32 and 34.

In FIG. 3(*b*), plunger 14 is shown partially depressed, and cam surface 13 has moved the free ends of elements 18 and 24 across lands 36 and 37 in a direction parallel with axis 23. Before plunger 14 reaches its fully depressed position, free end 20 is moved past line of inflection 41 at the intersection of side surface 40 and land 37. At that time, free end 20 springs along side surface 40 away from line of inflection 41 and is urged against segment 31 of element 29 so as to open the contact between terminals 32 and 33 and close the contact between terminals 32 and 34. This condition is illustrated in FIG. 3(*c*).

As plunger 14 is released, segment 31 of element 29 causes free end 20 of element 21 to slide along surface 40 of plunger 14 back toward line of inflection 41. Concurrently, the free end of element 24 is allowed by cam surface 13 to slide back across surface 36 of plunger 14 toward its initial position. When free end 20 passes the intersection of plunger surfaces 37 and 40, it springs across surface 37 away from the line of intersection and is urged against portion 27 of element 24.

Element 29 is configured to insure desired movement of free end 20 across line of inflection 41. Specifically, element 29 is configured with segment 31 forming an acute angle $\alpha$ with side surface 40. Free end 20 is confined to the acute angle between surface 40 and segment 31 when plunger 14 is depressed, and segment 31 tends to urge free end 20 away from surface 40 as plunger 14 is released.

As shown in FIGS. 3(*a*)–3(*c*), recess 42 in plunger 14 permits the end of segment 31 to extend slightly beyond surface 40 into the plunger. This insures that free end 20 cannot slip past segment 31 between the segment and the plunger.

In accordance with the foregoing description, the applicant has provided a snap acting electrical switch design having only a minimum number of simple inexpensive and easily assembled parts, most of which perform dual functions. For example, the plunger is biased to its released position by wire forms which also provide normally closed electrical contacts and electrical terminals for the switch. The other elements are also configured to cooperate in a unique manner to achieve the various functions required for a snap acting switch.

Although a specific embodiment of the applicant's switch is shown and described for illustrative purposes, a number of variations and modifications will be apparent to those of ordinary skill in the relevant arts. It is not intended that coverage be limited to the disclosed embodiment, but only by the terms of the following claims.

The embodiments of the invention in which an exclusive property or right is claimed are defined as follows:

1. A snap acting mechanism comprising:

a plunger adapted for reciprocal movement between released and depressed positions, said plunger having intersecting end and side surfaces which define a plane transverse to the side surface and containing at least a portion of the end surface;

a first resilient element having a fixed end, and having a free end biased to a position proximate the end surface of said plunger; and deflection means for deflecting the free end of said first resilient element across the end surface of said plunger toward the side surface thereof as said plunger is depressed, whereby when the free end of said first resilient element passes the intersection of the end and side surfaces its springs along the side surface away from the end surface, said deflection means including a stationary ramp surface extending traversely to the direction of movement of said plunger and passing through the plane defined by the end and side surfaces of said plunger at a location which moves toward the intersection of the end and side surfaces as said plunger is depressed.

2. The mechanism of claim 1 including a stationary element having a first end positioned proximate the intersection of the side and end surfaces of said plunger when said plunger is in its released position, the first end remaining proximate the side surface as said plunger is depressed, whereby as said plunger is released said stationary element moves the free end of said first resilient element past the intersection of the end and side surfaces, permitting the free end to spring across the end surface away from the intersection.

3. The mechansim of claim 2 wherein said deflection means includes a second resilient element having a fixed end, and having a free end located between said ramp surface and the free end of said first resilient element, the free end of said second resilient element being biased toward the end surface of said plunger.

4. The mechanism of claim 3 wherein said first resilient element and at least one of said second resilient element and said stationary element are electrically conductive so as to provide electrical continuity therebetween when the free end of said first resilient element and said at least one of said second resilient element and said stationary element are in contact.

5. The mechanism of claim 4 wherein:

said first and second resilient elements and said stationary element are electrically conductive; and the free end of said first resilient element is biased toward the free end of said second resilient element so as to provide a single pole, double throw switch.

6. The mechanism of claim 5 wherein:

said plunger is adapted for reciprocal movement along a first axis;

said ramp surface and the end surface of said plunger are adapted to move the first portions of said first and second resilient elements in a direction substantially parallel with a second axis perpendicular to the first axis;

said first and second resilient elements each include an intermediate segment connecting the fixed and free ends, the intermediate segments extending substantially perpendicular to the first and second axes; and the first end of said stationary element is configured to form an acute angle with the side surface of said plunger when said plunger is in its depressed position.

7. The mechanism of claim 6 wherein:

the end surface of said plunger includes a first land and a second land which projects from the first land;

the free end of said second resilient element includes a first portion which rides on the first land and extends along the second axis toward the free end of said first resilient element and a second portion adjacent the second land which extends substantially parallel with the first axis by an amount greater than the projection of the second land; and the free end of said first resilient element rides on the second land, extends substantially perpendicular to the first and second axes, and is biased in a direction to contact the second portion of said second resilient element.

8. A snap acting mechanism comprising:

a stationary member having a contact portion;

a first resilient member deflectable in first and second orthogonal directions from a rest position spaced in the first direction from the contact portion of said stationary member;

a plunger adapted for reciprocal movement along the second direction between released and depressed positions, said plunger having intersecting end and side surfaces, the end surface being proximate the rest position of said first resilient member when said plunger is in its released position, the side surface remaining proximate the contact portion of the stationary member as said plunger is depressed; and deflection means including a stationary cam surface for deflecting the free end of said first resilient member in the first direction toward the intersection of the end and side surfaces of said plunger as the free end of said first resilient member is deflected in the second direction by depression of said plunger, whereby as the free end of said first resilient element is deflected past the intersection of the end and side surfaces of said plunger it snaps along the side surface into contact with the contact portion of said stationary member.

9. The mechanism of claim 8 wherein said first resilient member has a fixed end spaced from the free end thereof in a third direction orthogonal to the first and second directions and an intermediate segment joining the free and fixed ends.

10. The mechanism of claim 9 wherein the contact portion of said stationary element is on a segment of the element which forms an acute angle with the side surface of said plunger when said plunger is in its depressed position.

11. The mechanism of claim 10 wherein said deflection means includes a second resilient member having a free end positioned between said cam surface and the free end of said first resilient member, said second resilient member being deflectable in the first direction from a rest position proximate said cam surface and the first end surface of said plunger.

12. The mechanism of claim 11 wherein said first resilient member and at least one of said second resilient member and said stationary member are electrically conductive so as to provide electrical continuity therebetween when the free end of said first resilient member and said at least one of said second resilient member and said stationary member are in contact.

13. The mechanism of claim 12 wherein:

said first and second resilient members and said stationary member are electrically conductive; and the free end of said first resilient member is biased toward the free end of said second resilient member so as to provide a single pole, double throw switch.

14. The mechanism of claim 13 wherein the fixed end of said second resilient member is spaced from the free end thereof in the third direction and includes an intermediate segment joining the fixed and free ends.

15. The mechanism of claim 14 wherein:

the end surface of said plunger includes a first land and a second land which projects from first land;

the free end of said second resilient member includes a first portion which rides on the first land and extends in the second direction toward the free end of said first resilient member and a second portion adjacent the second land which extends in the second direction by an amount greater the projection of the second land; and the free end of said first resilient member rides on the second land, extends in the third direction, and is biased to contact the second portion of said second resilient member.

16. An electrical switch comprising:

a housing;

a first resilient conductor having a fixed end held by said housing and a free end deflectable along first and second perpendicular axes from a rest position;

a rigid conductor having a first segment held by said housing and having a second segment which extends to a position along the first axis spaced from the rest position of the free end of said first resilient conductor;

a plunger guided in said housing for reciprocal movement along the second axis between released and depressed positions, said plunger having intersecting end and side surfaces, the end surface being proximate the rest position of the free end of said first resilient conductor and the side surface being parallel with the second axis and remaining adjacent the end of the second segment of said rigid conductor as said plunger is depressed; and deflection means including a cam surface on said housing for deflecting the free end of said first resilient conductor across the end surface of said plunger past the intersection of the end and side surfaces as the free end of said first resilient conductor is moved along the second axis by depression of said plunger, whereby upon passing the intersection, the free end of the first resilient element springs along the side surface into contact with the second segment of said stationary conductor.

17. The electrical switch of claim 16 including a second resilient conductor having a fixed end held by said housing and a free end positioned between said cam surface and the free end of said first resilient conductor, the free end of said second resilient conductor being biased against said cam surface and the end surface of said plunger, the free end of said first resilient conductor being biased against the free end of said second resilient conductor.

18. The electrical switch of claim 17 wherein each of said first and second resilient conductors includes an intermediate portion between the fixed and free ends thereof, the intermediate portion extending transverse to the first and second axes.

19. The electrical switch of claim 18 wherein the second segment of said rigid conductor is configured to form an acute angle with the side surface of said plunger when said plunger is in its depressed position.

20. The electrical switch of claim 19 wherein:

the end surface of said plunger includes a first land and a second land which projects from the first land along the second axis;

the free end of said second resilient conductor includes a first segment which rides on the first land and extends along the first axis toward the free end of said first resilient conductor and a second segment adjacent the second land which extends substantially parallel with the second axis by an amount greater than the projection of the second land; and the free end of said first resilient conductor rides on the second land, extends substantially perpendicular to the first and second axes.

21. The electrical switch of claim 1 wherein said first and second resilient conductors and said rigid conductors are formed of wire, and each has an end which extends through said housing to form an electrical terminal.

* * * * *

UNITED STATES PATENT AND TRADEMARK OFFICE

CERTIFICATE OF CORRECTION

PATENT NO. : 4,605,830

DATED : AUGUST 12, 1986

INVENTOR(S) : BRUCE E. REID

It is certified that error appears in the above-identified patent and that said Letters Patent is hereby corrected as shown below:

Claim 21, line 1, delete "1", insert --17--.

Signed and Sealed this

Thirteenth Day of January, 1987

*Attest:*

DONALD J. QUIGG

*Attesting Officer*

*Commissioner of Patents and Trademarks*